US007012382B2

(12) United States Patent
Cheang et al.

(10) Patent No.: US 7,012,382 B2
(45) Date of Patent: Mar. 14, 2006

(54) LIGHT EMITTING DIODE BASED LIGHT SYSTEM WITH A REDUNDANT LIGHT SOURCE

(76) Inventors: Tak Meng Cheang, 1004-03-11 Villa Emas Condo, Persiaran, Bayan Indah, SG, Nibong 11900 Penang (MY); Fook Chuin Ng, 5, Tingkat Mak Mandin 1, Taman Bayu, Mak Mandin 13400 Butterworth, Penang (MY); Choon Guan Ko, 31 A-20-05, Lorong Pekaka Satu, 11700 SC. Dua, Penang (MY); Choon Keat Chew, 19, Jalan Burung Sintar, IPOH Garden South, 31400 IPOH Perak (MY)

( * ) Notice: Subject to any disclaimer, the term of this patent is extended or adjusted under 35 U.S.C. 154(b) by 0 days.

(21) Appl. No.: 10/836,469

(22) Filed: Apr. 30, 2004

(65) Prior Publication Data

US 2005/0242742 A1 Nov. 3, 2005

(51) Int. Cl.
*H05B 37/00* (2006.01)

(52) U.S. Cl. ..... 315/291; 315/149; 315/312

(58) Field of Classification Search ..... 315/149–159, 315/291, 224, 307, 316, 312
See application file for complete search history.

(56) References Cited

U.S. PATENT DOCUMENTS

| | | | | |
|---|---|---|---|---|
| 6,095,661 | A * | 8/2000 | Lebens et al. | 315/224 |
| 6,441,558 | B1 * | 8/2002 | Muthu et al. | 315/149 |
| 6,498,440 | B1 * | 12/2002 | Stam et al. | 315/291 |
| 6,507,159 | B1 | 1/2003 | Muthu | |
| 6,753,661 | B1 * | 6/2004 | Muthu et al. | 315/149 |

* cited by examiner

*Primary Examiner*—Wilson Lee

(57) ABSTRACT

An LED-based light system includes a primary light source and at least one redundant light source. The primary light source is activated by itself and the performance of the light source is measured to determine whether nor not to drive the redundant light source. The redundant light source is activated when the performance measurements indicate that a performance characteristic is not being met by the primary light source alone. The first light system can be activated in combination with the redundant light source once the decision is made to activate the redundant light source.

17 Claims, 6 Drawing Sheets

LIGHT EMITTING DIODE BASED LIGHT SYSTEM WITH A REDUNDANT LIGHT SOURCE

BACKGROUND OF THE INVENTION

LED-based light systems are used to produce white light for applications such as liquid crystal display (LCD) backlighting. One technique for producing white light involves mixing the light from red, green, and blue (RGB) LEDs. White light generated from an RGB LED-based light system tends to be inconsistent in quality, especially as the LEDs degrade over time. Feedback control systems have been used to measure luminance and chrominance characteristics of the output light such as the brightness and color point and to adjust the LED drive signals to maintain the desired luminance and chrominance characteristics of the emitted white light. As time goes by, degradation of the individual LEDs in an LED-based light system causes changes in the brightness and shifts in the color point of the emitted white light. The feedback control system adjusts the drive signals to compensate for the changes in LED performance. Typically, as an LED-based light system degrades, the LEDs must be driven harder (e.g., with a higher drive voltage or drive current) to maintain the brightness of the red, green, and/or blue LEDs. Driving the LEDs harder causes the LEDs to dissipate more heat which further degrades LED performance.

At a certain point, the feedback control system will not be able to maintain the desired brightness and color point of the emitted white light due to the degradation of one or more of the LEDs. Although the LED-based light system is still able to produce white light, the light no longer has the desired luminance and chrominance characteristics and the LED-based light system must be replaced or the inferior quality of light accepted.

In view of this, what is needed is an LED-based light system that can produce light of a desired quality for longer than current LED-based light systems.

SUMMARY OF THE INVENTION

An LED-based light system includes a primary light source and at least one redundant light source. The primary light source is activated by itself and the performance of the light source is measured to determine whether nor not to drive the redundant light source. The redundant light source is activated when the performance measurements indicate that a performance characteristic is not being met by the primary light source alone. Using a redundant light source that is activated once the first light source cannot meet a performance characteristic extends the life of the LED-based light system.

The first light system can be activated in combination with the redundant light source once the decision is made to activate the redundant light source. Activating the light sources in combination allows the first light source to contribute to the overall light output even though it is no longer able to meet the desired performance characteristic.

Other aspects and advantages of the present invention will become apparent from the following detailed description, taken in conjunction with the accompanying drawings, illustrated by way of example of the principles of the invention.

BRIEF DESCRIPTION OF THE DRAWINGS

Throughout the description similar reference numbers may be used to identify similar elements.

DETAILED DESCRIPTION

Figure 1:
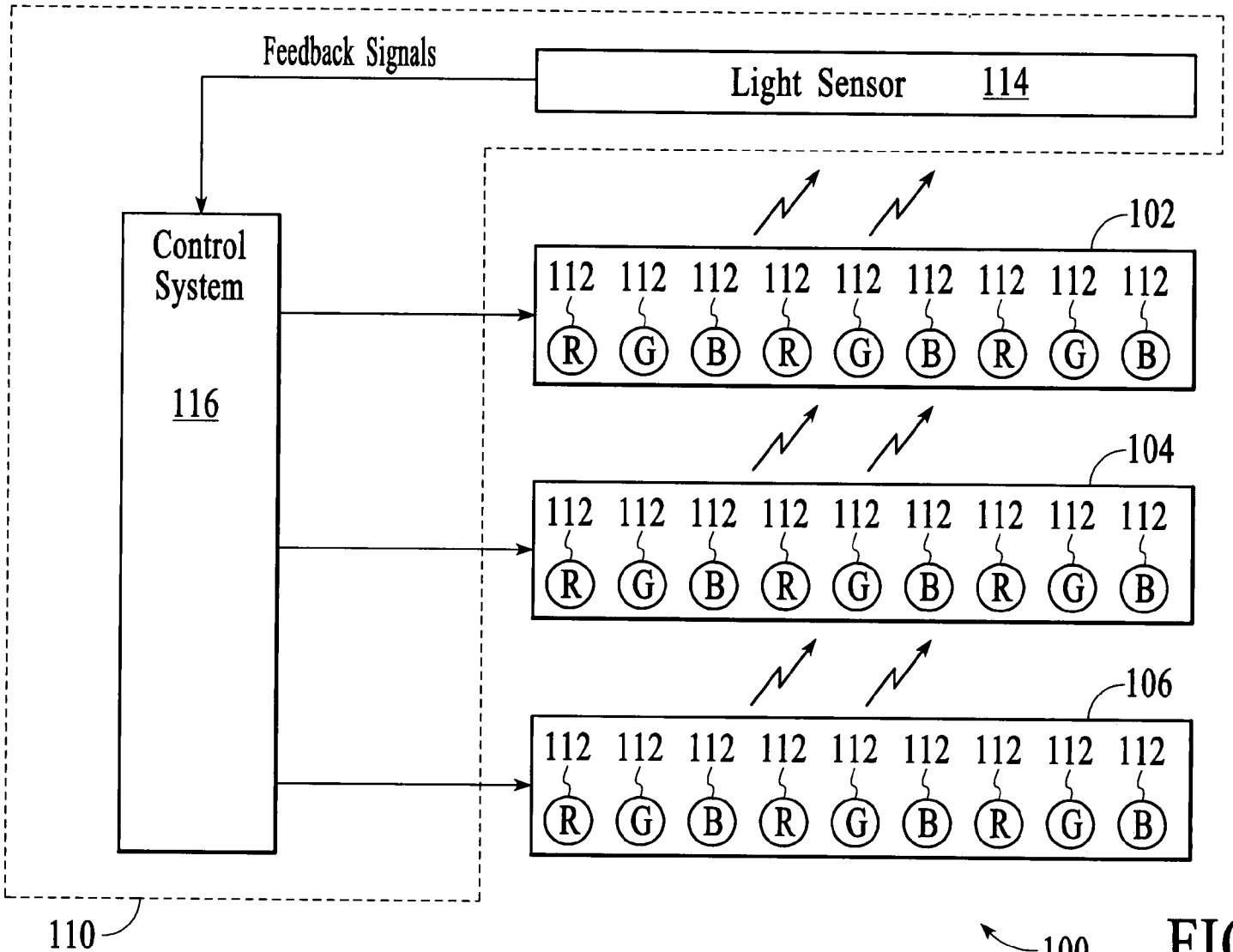
FIG. 1 depicts an LED-based light system in accordance with the invention that includes a primary light source, two redundant light sources, and a redundant light source management system.

FIG. 1 depicts an LED-based light system 100 in accordance with the invention that includes a primary light source 102, two redundant light sources 104 and 106, and a redundant light source management system 110. In the embodiment of FIG. 1, the primary and redundant light sources are identical to each other and, as is described in more detail below, are referred to as "primary" or "redundant" based on when they are activated. Each of the light sources includes multiple LEDs 112 that emit light in response to applied drive signals. The LEDs typically emit monochromatic light that may be of any color: A mix of different color LEDs, for example, a mix of red, green, and blue LEDs may be used in the light sources. The light sources as depicted in FIG. 1 may also include LED drivers that translate LED control signals into LED drive signals. LEDs and LED drivers are well-known.

The light sources 102, 104, and 106 are controlled by the redundant light source management system 110. The redundant light source management system depicted in FIG. 1 includes a light sensor 114 and a control system 116. The light sensor detects light that is emitted from the light sources and provides feedback signals to the control system. The light sensor includes one or more photosensors (not shown) which are oriented with respect to the light sources to detect light that is emitted from the light sources. The exact orientation of the light sensor relative to the light sources is not critical as long as the light sensor and light sources are in optical communication with each other.

The control system 116 receives the feedback signals from the light sensor 114 and generates LED control signals in response. The LED control signals are used to activate the individual LEDs 112 of the light sources 102, 104, and 106. The control system generates LED control signals that will cause the LEDs to emit light of desired luminance and chrominance characteristics (i.e., brightness and color point). In an embodiment, the control system compares luminance and chrominance characteristics indicated by the feedback signals to reference luminance and chrominance characteristics to determine which light source or light sources should be activated and to determine how the LED control signals should be adjusted to produce light having the desired luminance and chrominance characteristics.

In operation, the control system 116 generates LED control signals to control the light sources 102, 104, and 106. For description purposes, the operation starts with only the primary light source 102 being activated and therefore LED control signals are provided only to the primary light source. In response to the LED control signals, the primary light source emits light that is detected by the light sensor 114. The light sensor generates feedback signals in response to the detected light and provides the feedback signals to the control system. The control system uses the feedback signals to adjust the LED control signals to maintain the desired luminance and chrominance characteristics of the emitted light. The feedback process operates on a continuous basis to maintain the desired luminance and chrominance characteristics of the emitted light.

At some point, it is determined that the first redundant light source 104 should be activated in addition to the primary light source 102. In an embodiment, this determination is made based on measurements of the light that is emitted from the primary light source. In particular, the redundant light source is activated when measurements of the emitted light indicate that the light emitted from the primary light source alone does not have the desired luminance and chrominance characteristics.

Once the determination is made that the first redundant light source 104 should be activated, the control system 116 causes LED control signals to be provided to the first redundant light source as well as to the primary light source 102. The light that is emitted from the combination of the redundant and the primary light sources is then detected by the light sensor 114. Feedback signals generated by the light sensor continue to be used to adjust the LED control signals to maintain the desired luminance and chrominance characteristics of the emitted light.

The feedback and adjustment process continues as described above while both the primary and first redundant light sources 102 and 104 are activated. At some point, it is determined that the second redundant light source 106 should be activated in addition to the primary and first redundant light sources. This decision is made in the same manner as the decision to activate the first redundant light source. That is, the second redundant light source is activated when measurements of the emitted light indicate that the light emitted from the primary and first redundant light sources does not have the desired luminance and chrominance characteristics.

The process of measuring the performance of light sources and activating redundant light sources in a cumulative manner can be applied to any LED-based light system that includes at least one redundant light source. Although one primary light source 102 and two redundant light sources 104 and 106 are shown in FIG. 1, embodiments with only one redundant light source or more than two redundant light sources are possible. An advantage of the LED-based light system described above is that the life of the LED-based light system is extended over systems that do not include redundant light sources.

Figure 2:
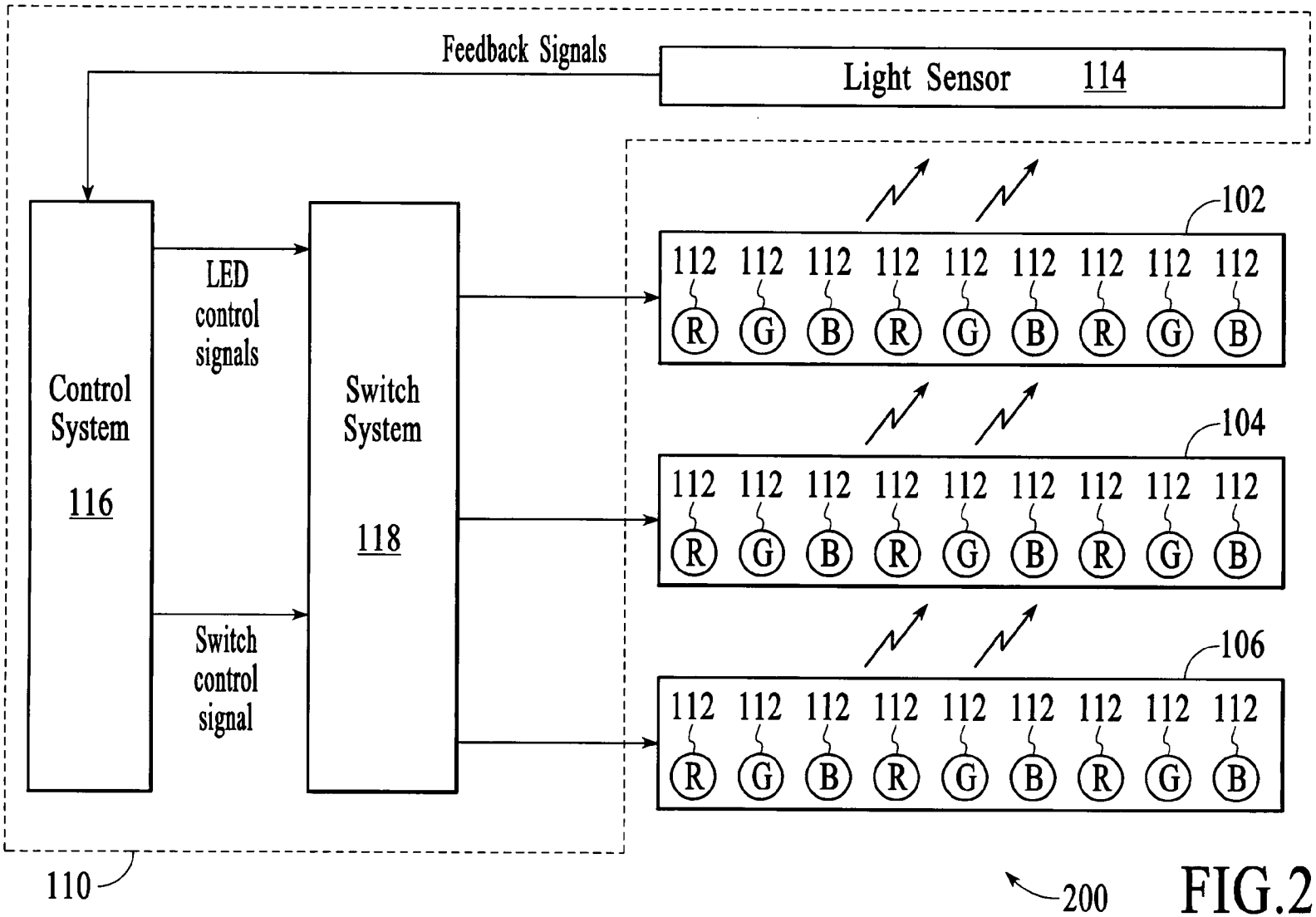
FIG. 2 depicts an embodiment of an LED-based light system in accordance with the invention in which the redundant light source management system includes separate control and switching functions.

FIG. 2 depicts an embodiment of an LED-based light system 200 in which the redundant light source management system 110 includes separate control and switching functions. In the embodiment of FIG. 2, the redundant light source management system includes a light sensor 114, a control system 116, and a switch system 118. The light sensor is the same as the light sensor of FIG. 1. The control system is similar to the control system of FIG. 1 except that the LED control signals are directed to the intended light sources via the switch system. In addition to generating the LED control signals, the control system also generates a switch control signal that indicates which light sources are to receive the LED control signals from the control system.

The switch system 118 receives switch control signals from the control system 116 and in response, controls which light sources receive the LED control signals that are generated by the control system. In an embodiment, the switch system is configured to provide the LED control signals to the light sources in a cumulative manner. That is, the LED control signals are provided to the primary light source 102, to the primary light source 102 and the first redundant light source 104, or to the primary light source 102 the first redundant light source 104 and the second redundant light source 106. The switch system may include, for example, mechanical or solid state relays.

In operation, the primary light source 102 is initially the only light source being activated and therefore the switch control signal causes the switch system 118 to provide the LED control signals only to the primary light source. In response to the LED control signals, the primary light source emits light that is detected by the light sensor 114. The light sensor generates feedback signals in response to the detected light and provides the feedback signals to the control system 116 as described above.

At some point, it is determined that the first redundant light source 104 should be activated in addition to the primary light source 102. Once this determination is made, the control system 116 generates a switch control signal that causes the LED control signals to be provided to the first redundant light source as well as to the primary light source. The light that is emitted from the combination of the primary and first redundant light sources is then detected by the light sensor 114 and the LED control signals are adjusted as described above to maintain the desired luminance and chrominance characteristics of the emitted light. The process continues as described above while both the primary and first redundant light sources are activated. At some point, it is determined that the second redundant light source 106 should be activated in addition to the primary and first redundant light sources 102 and 104. Once this determination is made, the control system generates a switch control signal that causes the LED control signals to be provided to the second redundant light source as well as to the primary and first redundant light sources. The light that is emitted from the primary, the first redundant, and the second redundant light sources is then detected by the light sensor and the LED control signals are adjusted as described above to maintain the desired luminance characteristics of the emitted light.

An advantage of the system 200 of FIG. 2 is that the control system 116 requires only one set of LED control signals to activate all of the light sources 102, 104, and 106 regardless of how many light sources are being activated. That is, the same set of LED control signals is able to control all three of the light sources. Using only one set of LED control signals to control multiple light sources reduces the complexity of the redundant light source management system 110.

An advantage of activating the light sources 102, 104, and 106 in a cumulative manner as described above is that light sources that no longer are able to meet the desired luminance and chrominance characteristics alone still contribute to the overall light output. In this way, the LED-based light system is able to take advantage of the light emitted from underperforming light sources while ensuring the desired luminance and chrominance characteristics are met. For example, although the light emitted from a light source has degraded to the point where it is no longer able to meet the luminance and chrominance requirements alone, it can still contribute to the spectral power and brightness of the emitted light, thereby lowering the burden on the redundant light source or light sources. The cumulative approach extends the life of the light system over a light system that switches from one light source to the next light source without continuing to drive the degraded light source or light sources. Although a cumulative approach to activating the light sources is described, other approaches (e.g., activating only one light source at a time) are possible.

Figure 3:
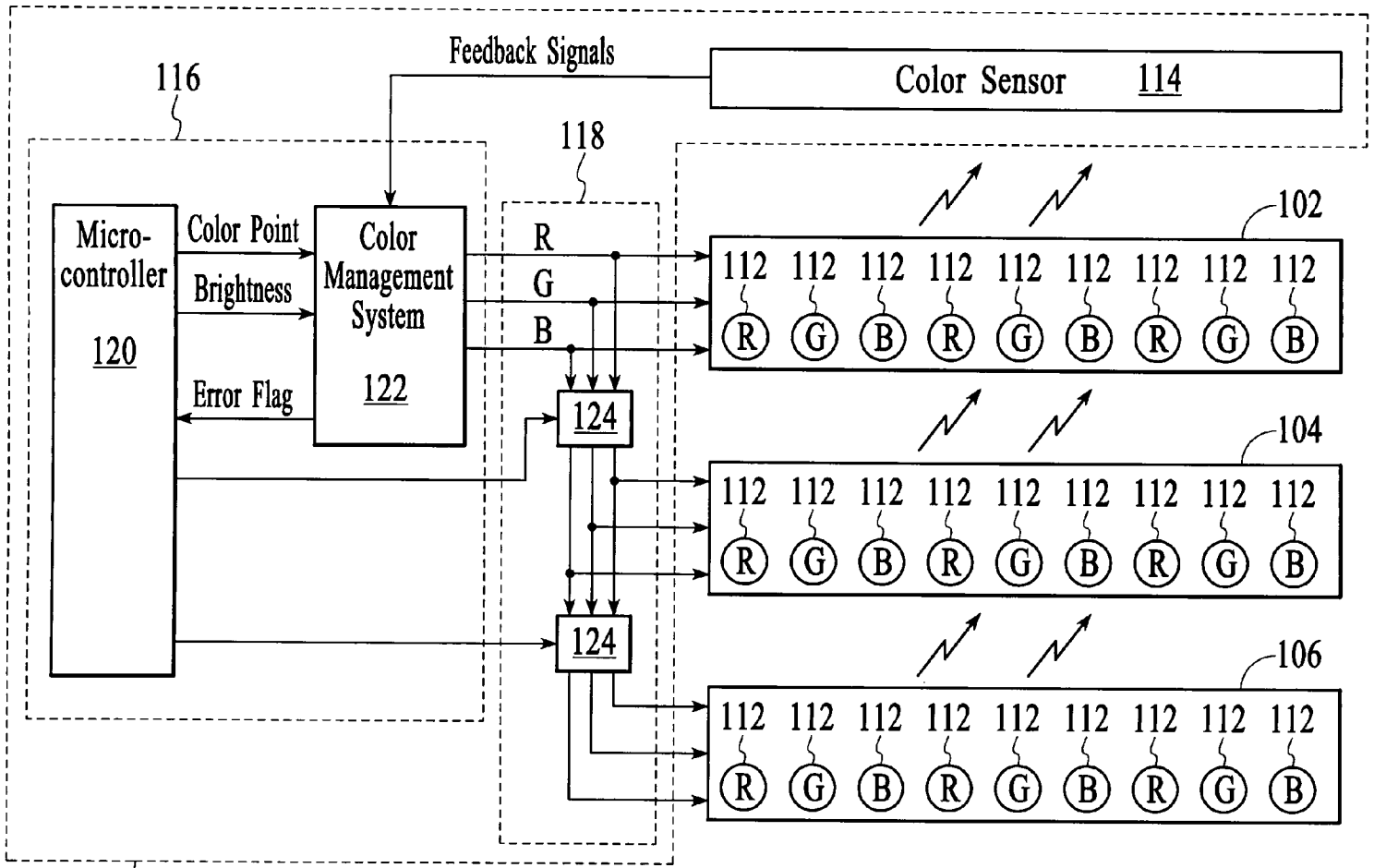
FIG. 3 depicts an embodiment of an LED-based light system in accordance with the invention, which controls the light sources on a per-color basis.

As described above, the light sources 102, 104, and 106 may include multiple color LEDs, such as red, green, and blue LEDs. It is often desirable to control the color LEDs on a color-specific basis in response to feedback signals that include color-specific information. FIG. 3 depicts an embodiment of an LED-based light system 300 that controls the light sources on a per-color basis. The LED-based light system includes a primary light source 102, two redundant light sources 104 and 106, and a redundant light source management system 110. The light sources are identical to each other and include a mix of red, green, and blue LEDs 112.

The redundant light source management system 110 includes a color sensor 114, a control system 116, and a switch system 118. The light sensor detects light that is emitted from the light sources and provides feedback signals with color-specific information to the control system. The control system includes a microcontroller 120 and a color management system 122. The microcontroller provides reference luminance and chrominance information (i.e., brightness and color point information) to the color management system. The color management system uses the reference luminance and chrominance information and the feedback signals from the color sensor to generate color-specific LED control signals. As depicted in FIG. 3, the color management system generates color-specific LED control signals for the red, green, and blue LEDs. Example embodiments of the color management system are described below with reference to FIGS. 4A and 4B.

The switch system 118 is configured such that it can distribute the LED control signals to each of the light sources 102, 104, and 106. Additionally, the switch system is configured to provide the LED control signals to the light sources in a cumulative manner (e.g., to the primary light source 102, to the primary and first redundant light sources 102 and 104, or to the primary, first redundant, and second redundant light sources 102, 104, and 106). The switch system depicted in FIG. 3 includes a first switch 124 that prevents the LED control signals from reaching the first or second redundant light sources and a second switch 126 that prevents the LED control signals from reaching the second redundant light source. The first and second switches may be, for example, mechanical or solid-state relays. Although an example switch system is described herein, other embodiments of the switch system are possible.

In operation, the primary light source 102 is initially the only light source being controlled by the color management system 122. This is accomplished by turning off the two switches 124 and 126 of the switch system 118 (i.e., blocking the transmission of the LED control signals to the redundant light sources). The color sensor measures performance characteristics (e.g., luminance and chrominance) of the light that is emitted from the primary light source and provides the performance measurements to the color management system as feedback signals. The color management system compares the performance characteristic measurements to desired performance characteristics. Once it is determined that the desired performance characteristics are not being met by the primary light source alone, an error flag is generated by the color management system. The error flag is provided to the microcontroller 120 and causes the microcontroller to generate a first switch control signal. The first switch control signal turns on the first switch 124 within the switch system 118, which causes the LED control signals to be provided to the first redundant light source 104 in addition to the primary light source 102. In response to the first switch control signal and the LED control signals, light is emitted from both the primary and first redundant light sources. The emitted light is then detected by the color sensor and the resulting feedback signals are used by the color management system to adjust the LED control signals.

Once it is determined that the desired performance characteristics are not being met by the primary and first redundant light sources 102 and 104, a second error flag is generated by the color management system 122. The second error flag is provided to the microcontroller 120 and causes the microcontroller to generate a second switch control signal. The second switch control signal turns on the second switch 126 within the switch system 118, which causes the LED control signals to be provided to the second redundant light source 106 in addition to the primary and first redundant light sources 102 and 104. In response to the first and second switch control signals and the LED control signals, light is emitted from the primary, the first redundant, and the second redundant light sources. The emitted light is then detected by the color sensor and the resulting feedback signals are used by the color management system to adjust the LED control signals.

As described above, an advantage of activating the light sources in a cumulative manner is that light sources that no longer are able to meet the desired luminance and chrominance characteristics alone still contribute to the overall light output. This advantage is illustrated in the LED-based light system 300 of FIG. 3 in which the light sources 102, 104, and 106 have a mix of red, green, and blue LEDs 112. For example, if only the blue LEDs in the primary light source are degraded to a point where the light source cannot meet the desired performance characteristic alone, it would be wasteful to shut off the entire primary light source 102 and switch to the redundant light source 104. By activating the primary and first redundant light sources in a cumulative manner, the LEDs of both panels can be individually driven at lower levels to produce the same spectral power. Driving the LEDs at a lower level slows the degradation of the LEDs.

For the purposes of example, the LED-based light systems 100, 200, and 300 depicted in FIGS. 1–3 may be three color ("trichromatic") RGB based systems. The colored light of a trichromatic system may be described in terms of tristimulus values, based on matching the three colors such that the colors typically cannot be perceived individually. Tristimulus values represent the intensity of three matching lights, in a given trichromatic system, required to match a desired shade. Tristimulus values can be calculated using the following equations:

$$X = k\sum_{\lambda} W\bar{x}_{\lambda} R_{\lambda}$$

$$Y = k\sum_{\lambda} W\bar{y}_{\lambda} R_{\lambda}$$

$$Z = k\sum_{\lambda} W\bar{z}_{\lambda} R_{\lambda}$$

where $W\bar{x}_{\lambda}=P_{\lambda}x_{\lambda}$ $W\bar{y}_{\lambda}=P_{\lambda}y_{\lambda}$ $W\bar{z}_{\lambda}=P_{\lambda}z_{\lambda}$ $k=100/\Sigma W\ y_{\lambda}$ The relative spectral power distribution, $P_{\lambda}$, is the spectral power per constant-interval wavelength throughout the spectrum relative to a fixed reference value. The CIE color matching functions, $x_{\lambda}$, $y_{\lambda}$, and $z_{\lambda}$, are the functions $x(\lambda)$, $y(\lambda)$, and $z(\lambda)$ in the CIE 1931 standard calorimetric system or the functions $x_{10}(\lambda)$, $y_{10}(\lambda)$, and $z_{10}(\lambda)$ in the CIE 1964 supplementary standard colorimetric system. The CIE 1931 standard calorimetric observer is an ideal observer whose color matching properties correspond to the CIE color matching functions between 1° and 4° fields, and the CIE 1964 standard calorimetric observer is an ideal observer whose color matching properties correspond to the CIE color matching functions for field sizes larger than 4°. The reflectance, $R_{\lambda}$, is the ratio of the radiant flux reflected in a given cone, whose apex is on the surface considered, to that reflected in the same direction by the perfect reflecting diffuser being irradiated. Radiant flux is power emitted, transferred, or received in the form of radiation. The unit of radiant flux is the watt (W). A perfect reflecting diffuser is an ideal isotropic diffuser with a reflectance (or transmittance) equal to unity. The weighting functions, $Wx_{\lambda}$, $Wy_{\lambda}$, and $Wz_{\lambda}$, are the products of relative spectral power distribution, $P_{\lambda}$, and a particular set of CIE color matching functions, $x_{\lambda}$, $y_{\lambda}$, and $z_{\lambda}$.

Figure 4A:
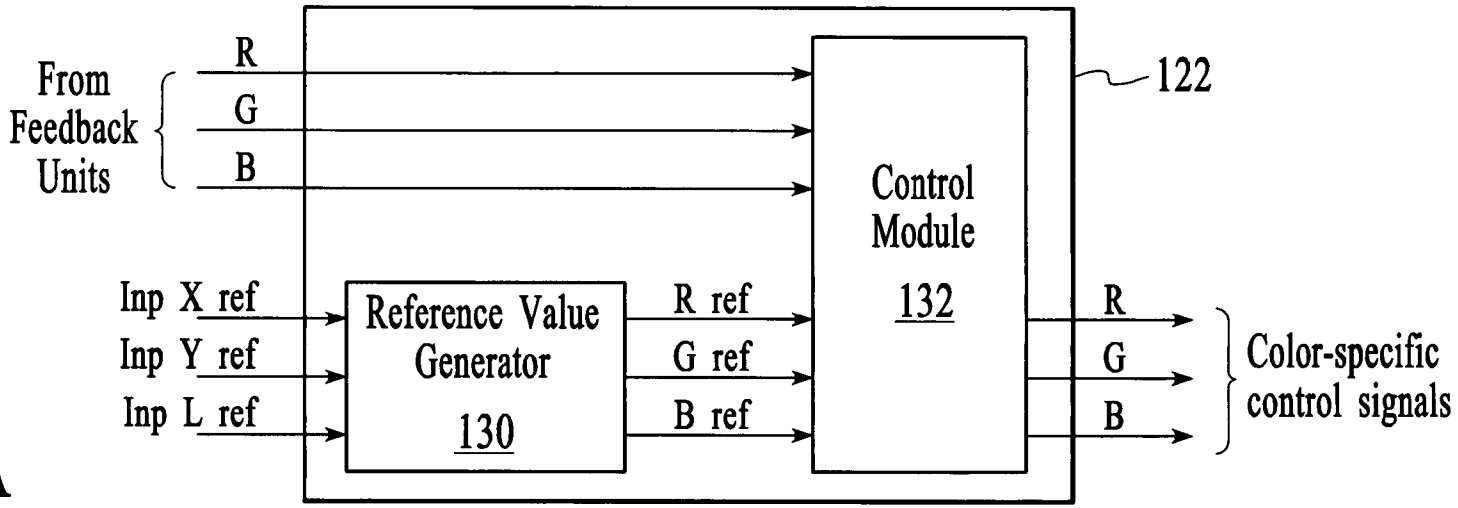
FIG. 4A is an expanded view of the color management system from FIG. 3.
Figure 4B:
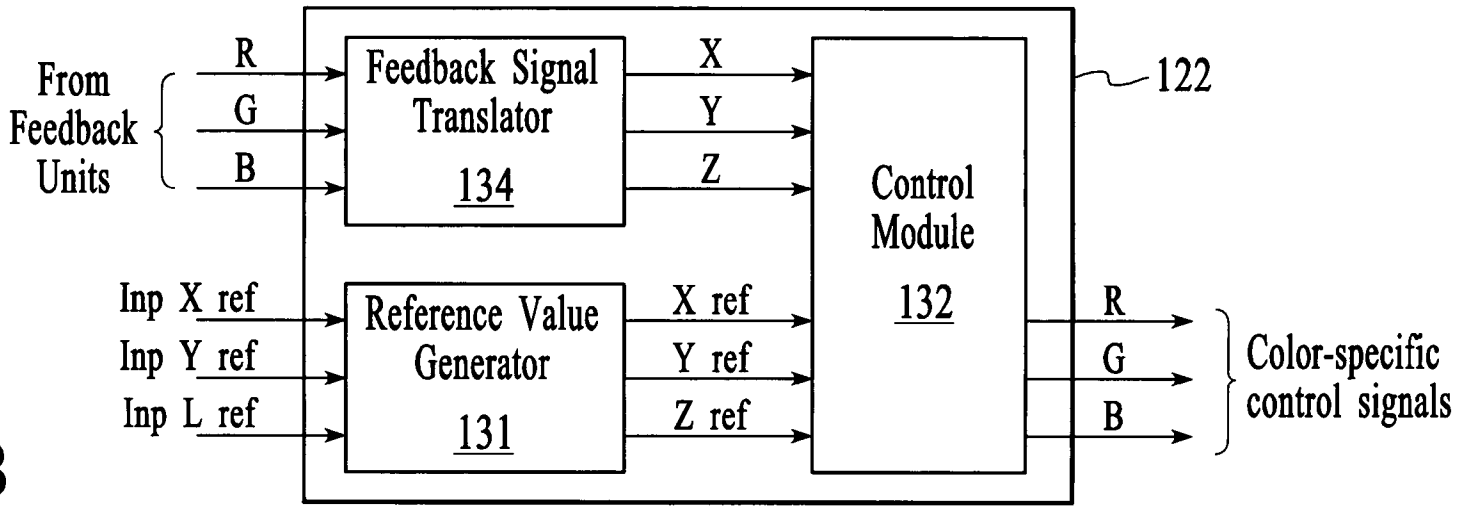
FIG. 4B is an expanded view of another embodiment of the color management system from FIG. 3 that uses CIE 1931 tristimulus values.
Figure 5:
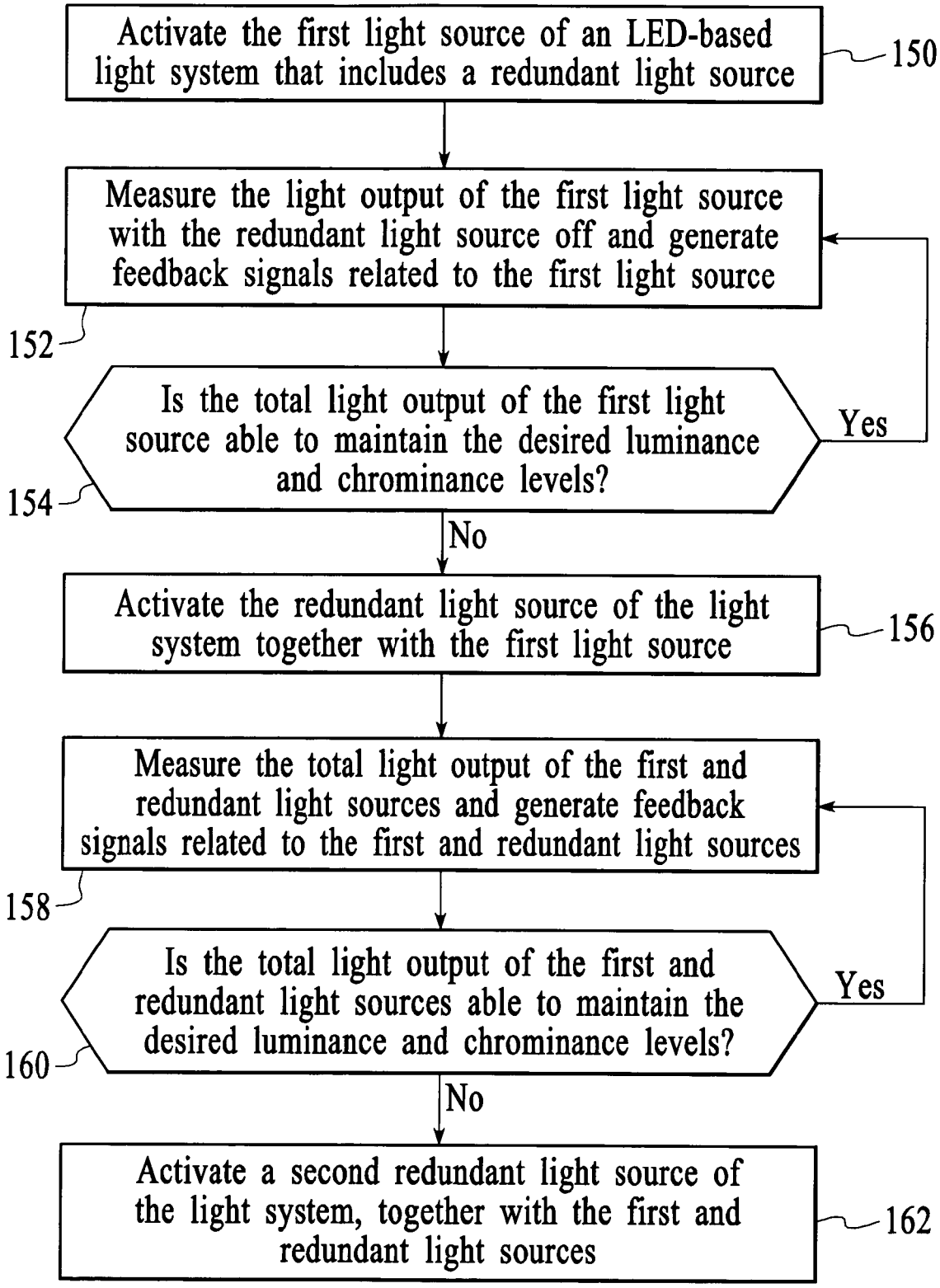
FIG. 5 depicts a process flow diagram of a method for controlling an LED-based light system in accordance with the invention.

With reference to FIG. 3, the color management system 122 can be implemented in many different ways to achieve color-specific control. FIGS. 4A and 4B depict examples of color management systems that can be used to adjust the red, green, and blue LEDs of the light systems on a per-color basis. With reference to FIG. 4A, the color management system 116 includes a reference value generator 130 and a control module 132. The color management system receives color-specific feedback signals in the form of measured tristimulus values in RGB space (R, G, and B) from the color sensor 114. The color management system also receives input reference tristimulus values. The input reference tristimulus values may be in the form of a target white color point (X ref and Y ref) and lumen value (L ref). A user may enter the input reference tristimulus values through a user interface (not shown) or the input reference tristimulus values could be received in some other manner. The reference value generator translates the input reference tristimulus values to reference tristimulus values in RGB space (R ref, G ref, and B ref). The control module then determines the difference between the measured tristimulus values and reference tristimulus values and generates color-specific LED control signals that reflect adjustments that need to be made on a per-color basis to achieve the desired color. The color-specific LED control signals cause the color LEDs 112 to be adjusted, as necessary, to emit light of the desired color. In this way, the luminance and chrominance characteristics of the light source approach the desired (i.e., reference) luminance and luminance characteristics.

The alternate color management system 116 of FIG. 4B is similar to the color management system of FIG. 4A except that it uses CIE 1931 tristimulus values. The color management system includes a feedback signal translator 134 that translates measured tristimulus values in RGB space to measured CIE 1931 tristimulus values. Additionally, the reference value generator 131 converts input reference tristimulus values to reference CIE 1931 tristimulus values. The control module 132 then determines the difference between the measured CIE 1931 tristimulus values and the reference CIE 1931 tristimulus values and adjusts the color-specific LED control signals accordingly.

Figure 6:
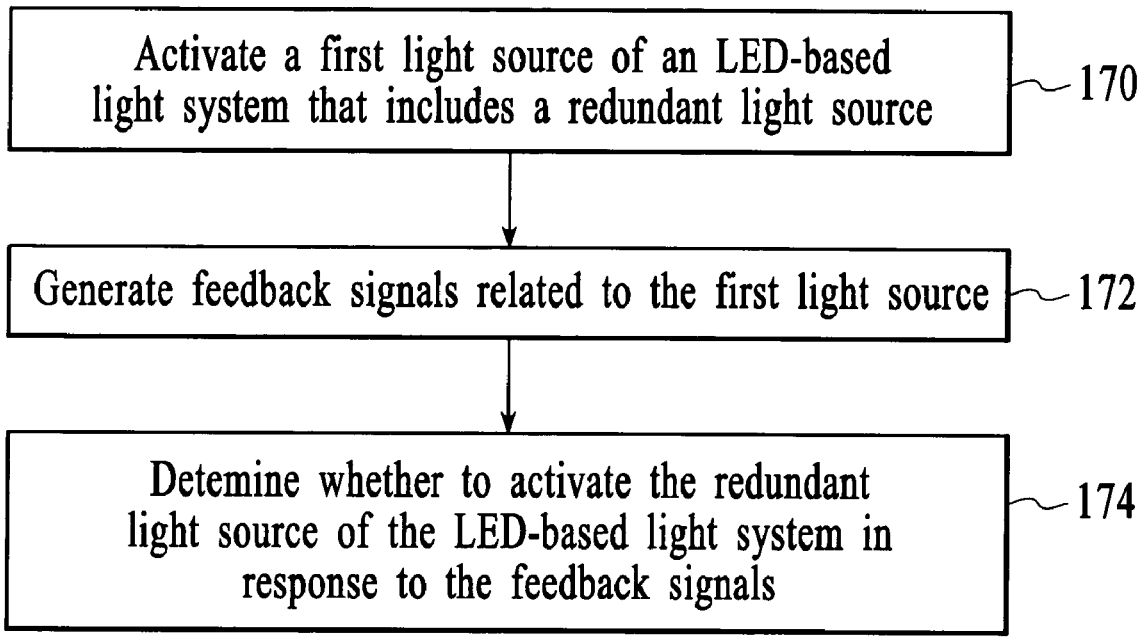
FIG. 6 depicts a process flow diagram of a method for controlling an LED-based light system in accordance with the invention.

FIG. 6 depicts a process flow diagram of a method for controlling an LED-based light system in accordance with the invention. At block 150, the first light source of an LED-based light system that includes a redundant light source is activated. At block 152, the light output of the first light source is measured with the redundant light source off and feedback signals related to the first light source are generated. At decision point 154, it is determined if the total light output of the first light source is able to maintain the desired luminance and chrominance level. The process returns to block 152 until the luminance and chrominance levels are not able to be maintained by the first light source. At block 156, the redundant light source of the light system is activated together with the first light source. At block 158, the total light output of the first and redundant light sources is measured and feedback signals related to the first and redundant light sources are generated. At decision point 160, it is determined if the total light output of the first and redundant light sources is able to maintain the desired luminance and chrominance levels. The process returns to block 158 until the luminance and chrominance levels are not able to be maintained by the first and redundant light sources. At block 162, s second redundant light source of the light system is activated together with the first and redundant light sources.

FIG. 6 depicts a process flow diagram of a method for controlling an LED-based light system in accordance with the invention. At block 170, a first light source of an LED-based light system that includes a redundant light source is activated. At block 172, feedback signals related to the first light source are generated. At block 174, it is determined whether to activate the redundant light source of the LED-based light system in response to the feedback signals.

Although the light sources are described as identical to each other with reference to FIGS. 1–3, the light sources can be different from each other.

In an embodiment, the LED-based light systems are used to produce white light for LCD backlighting. Alternatively, the LED-based light systems can be used in any other light application and are in no way limited to backlighting for LCD panels.

Other embodiments of the redundant light source management system 110 that provide feedback signals, adjust the LEDs in response to the feedback signals, and activate the redundant light sources in response to the feedback signals are possible.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. A method for controlling a light emitting diode (LED) based light system comprising:

activating a first light source of an LED-based light system that includes a redundant light source;

generating feedback signals related to the first light source;

determining whether to activate the redundant light source of the LED-based light system in response to the feedback signals; and activating the redundant light source if the feedback signals indicate that a performance characteristic is not being met by the first light source alone.

2. The method of claim 1 wherein the performance characteristic includes at least one of color point and brightness.

3. The method of claim 1 wherein generating feedback signals includes measuring the color point of light emitted by the first light source.

4. The method of claim 1 wherein generating feedback signals includes measuring the brightness of tight emitted by the first light source.

5. The method of claim 1 further including activating the redundant light source in addition to the first light source if the feedback signals indicate that a performance characteristic is not being met by the first light source alone.

6. The method of claim 5 wherein the first light source and the redundant light source are activated with the same LED control signals.

7. A light emitting diode (LED) based light system comprising:

a first light source;

a redundant light source;

means, in optical signal communication with the first light source and electrical signal communication with the first and the redundant light sources, for:

activating the first light source;

generating feedback signals related to the first light source;

determining whether to activate the redundant light source in response to the feedback signals; and means for activating the redundant light source if the feedback signals indicate that a performance characteristic is not being met by the first light source alone.

8. The LED-based light system of claim 7 wherein generating feedback signals includes measuring at least one of color point and brightness.

9. The LED-based light system of claim 7 wherein generating feedback signals includes measuring the color point of light emitted by the first light source.

10. The LED-based light system of claim 7 wherein generating feedback signals includes measuring the brightness of light emitted by the first light source.

11. The LED-based light system of claim 7 wherein the means for activating, generating, and determining further includes means for activating the redundant light source in addition to the first light source if the feedback signals indicate that a performance characteristic is not being met by the first light source alone.

12. The LED-based light system of claim 11 wherein the means for activating, generating, and determining further includes means for activating the redundant light source with the same LED control signals that are used to activate the first light source.

13. The LED-based light system of claim 7 wherein the means for determining includes a control system and a switch system, the control system being configured to receive the feedback signals related to the first light source and to provide a switch control signal to the switch system, the switch system configured to provide LED control signals to the redundant light source in response to the switch control signal from the control system.

14. A light emitting diode (LED) based light system comprising:

a first light source;

a redundant light source;

a redundant light source management system in optical signal and electrical signal communication with the first and the redundant light sources, the redundant light source management system configured to activate the first light source, to generate feedback signals related to the first light source, and to determine whether to activate the redundant light source in response to the feedback signals, wherein the redundant light source management system is further configured to activate the redundant light source if the feedback signals indicate that a performance characteristic is not being met by the first light source alone.

15. The LED-based light system of claim 14 wherein the redundant light source management system includes a control system and a switch system, the control system being configured to receive the feedback signals related to the first light source and to provide a switch control signal to the switch system, the switch system configured to provide LED control signals to the redundant light source in response to the switch control signal from the control system.

16. The LED-based light system of claim 14 wherein the redundant light source management system includes a switch that is configured to allow LED control signals to the redundant light source if the feedback signals indicate that a performance characteristic is not being met by the first light source alone.

17. The LED-based light system of claim 16 wherein the redundant light source management system includes a color sensor, a color management system, and a microcontroller, the color sensor configured to detect light emitted from the first light source and to provide the feedback signals to the color management system, the color management system configured to compare luminance and chrominance characteristics indicated by the feedback signals to luminance and chrominance reference values and to output an indication of the comparison to the microcontroller, the microcontroller configured to control the switch in response to the output from the color management system.

* * * * *